US006595657B1

(12) United States Patent
Shieh

(10) Patent No.: US 6,595,657 B1
(45) Date of Patent: Jul. 22, 2003

(54) LAMP HOLDER AND SOCKET STRUCTURE FOR MINIATURE DECORATIVE LIGHT

(76) Inventor: Whiter Shieh, 6F, No. 245, Tun Hua South Road, Sec. 1, Taipei, 106 (TW)

( * ) Notice: Subject to any disclaimer, the term of this patent is extended or adjusted under 35 U.S.C. 154(b) by 0 days.

(21) Appl. No.: 10/087,842

(22) Filed: Mar. 5, 2002

(51) Int. Cl.[7] ..... H01R 33/00

(52) U.S. Cl. ..... 362/226; 362/806; 362/448; 439/699.2

(58) Field of Search ..... 362/226, 806, 362/448, 249, 257; 439/356, 619, 611, 699.1, 699.2, 419

(56) References Cited

U.S. PATENT DOCUMENTS 4,999,751 A * 3/1991 Chen ..... 362/226
5,915,826 A * 6/1999 Lin ..... 362/226
6,113,430 A * 9/2000 Wu ..... 439/619

* cited by examiner

*Primary Examiner*—Sandra O'Shea
*Assistant Examiner*—Ali Alavi
(74) *Attorney, Agent, or Firm*—Rosenberg, Klein & Lee

(57) ABSTRACT

A lamp holder and socket structure for miniature decorative light includes a lamp socket, a miniature lamp holder, a pair of metal contact plates, a pair of wires, and a miniature decorative lamp. The miniature lamp holder includes a body portion having a lower opening and an upward tapered extension portion above the body portion. The extension portion is provided at a top with an upper opening for the miniature decorative lamp to mount thereto. A middle dam is formed in an internal space of the body portion of the miniature lamp holder to separate the lower opening thereof into two through holes. A lower part of the middle dam projects from the bottom of the miniature lamp holder to provide a projected dam portion.

5 Claims, 9 Drawing Sheets

LAMP HOLDER AND SOCKET STRUCTURE FOR MINIATURE DECORATIVE LIGHT

BACKGROUND OF THE INVENTION

1. Field of the Invention

The present invention relates to a lamp socket structure, and more particularly to a lamp holder and socket structure for miniature decorative light, to which a miniature decorative lamp or a miniature light-emitting element can be securely and safely mounted and then connected to conductors.

2. Description of the Prior Art

Decorative light strings are widely used in festivities, particularly in Christmas. Such light string typically includes a power cord to which a plurality of lamp sockets are connected for holding decorative lamps thereto. Recently, miniature light-emitting elements or miniature decorative lamps are used to produce light strings that provide attractive visual effect through densely distributed fine decorative lamps. Thus, these miniature decorative lamps and light-emitting elements have been largely employed in Christmas light strings and tend to replace the position of conventional normal-size decorative lamps.

Such decorative light strings can be used indoors without taking too much consideration about the electrical safety and structural strength thereof. However, to use these decorative light strings outdoors, it is a must to consider particularly the electrical safety in use thereof. For example, the light strings must be provided on power cords that have enough thickness to provide the light strings with sufficient tensile strength. However, this condition inevitably complicates the relation among the power cords, the lamp sockets and the lamps, and makes the light strings more difficult to handle.

With conventional skills, the miniature decorative lamp is associated with the lamp socket and connected to the power cord generally by directly soldering copper conductors of two wires to two connecting wires of the miniature decorative lamp, and then putting a thermal-shrinkage sleeve around each joint of the lamp and the socket, which is then heated with a heat source, such as a hair dryer, to thermally shrink the sleeve, so that the shrunk sleeve tightly encloses the lamp and the wire as well as the soldered joint of them to serve as an insulating material thereof. The above-described conventional skill for producing light strings is completely manual and has low productivity. Moreover, the light strings so produced are subject to damage due to external pressure and are not safe for use.

SUMMARY OF THE INVENTION

It is therefore a primary object of the present invention to provide a lamp holder and socket structure for miniature decorative light that enables a miniature decorative lamp to securely mount on the lamp socket while the lamp socket allows wires having big thickness to connect thereto.

Another object of the present invention is to provide a lamp holder and socket structure for miniature decorative light that provides better electrical safety for use. After the miniature decorative lamps are associated with the lamp sockets to produce a light string, the light string can be used with high electrical safety.

To achieve the above objects, in accordance with the present invention, there is provided a lamp holder and socket structure including a lamp socket, a miniature lamp holder, a pair of metal contact plates, a pair of wires, and a miniature decorative lamp. The miniature lamp holder includes a body portion having a lower opening and an upward tapered extension portion above the body portion. The extension portion is provided at a top with an upper opening for the miniature decorative lamp to mount thereto. A middle dam is formed in an internal space of the body portion of the miniature lamp holder to separate the lower opening thereof into two through holes. A lower part of the middle dam projects from the bottom of the miniature lamp holder to provide a projected dam portion.

BRIEF DESCRIPTION OF THE DRAWINGS

The structure adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
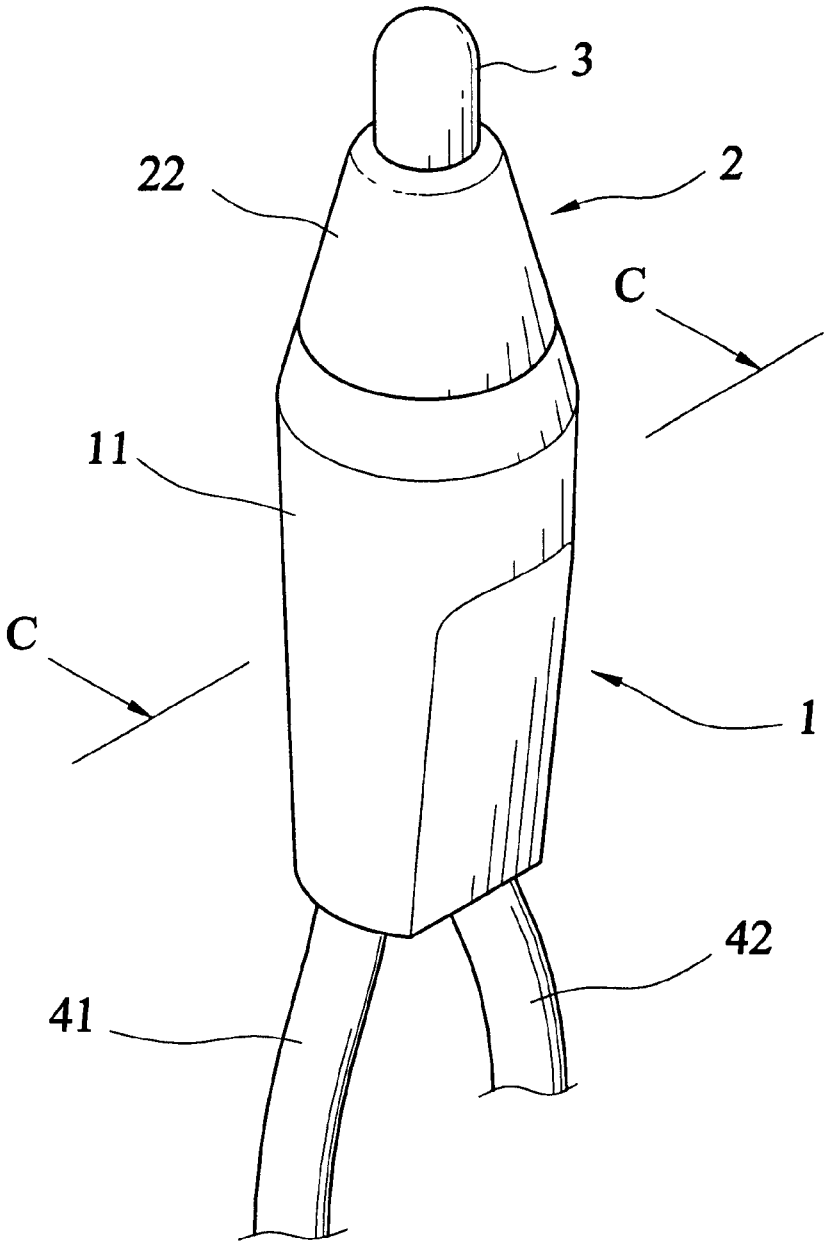
FIG. 1 is an assembled perspective view of a lamp holder and socket structure for miniature decorative light according to a first embodiment of the present invention.
Figure 2:
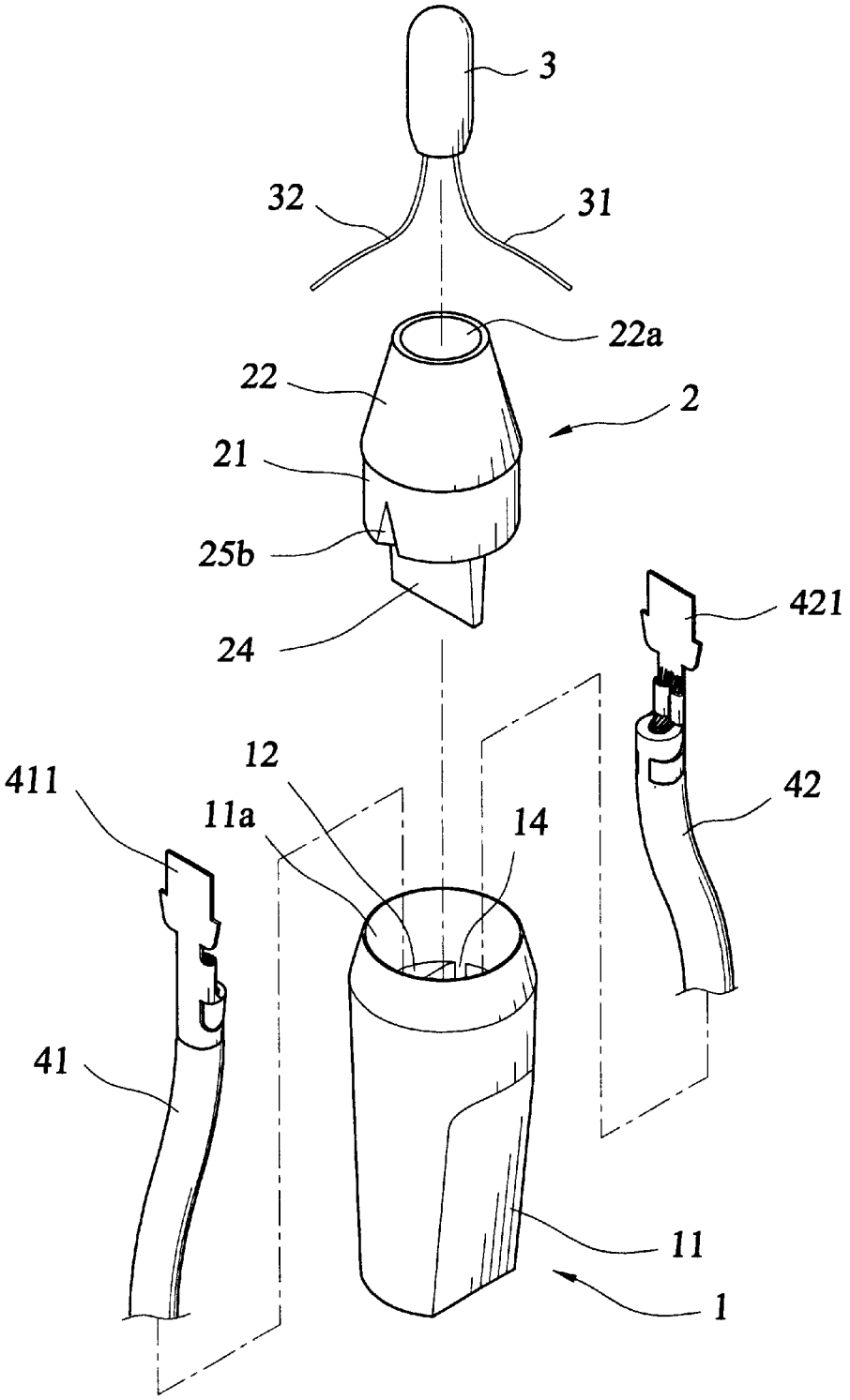
FIG. 2 is an exploded perspective view of FIG. 1.

Please refer to FIGS. 1 and 2 that are assembled and exploded perspective views, respectively, of a lamp holder and socket structure for miniature decorative light according to a first embodiment of the present invention. As shown, the structure of present invention mainly includes a lamp socket 1, a miniature lamp holder 2, and a miniature decorative lamp 3. The miniature decorative lamp 3 is adapted to mount to a top of the miniature lamp holder 2, which is then connected to the lamp socket 1.

Figure 3:
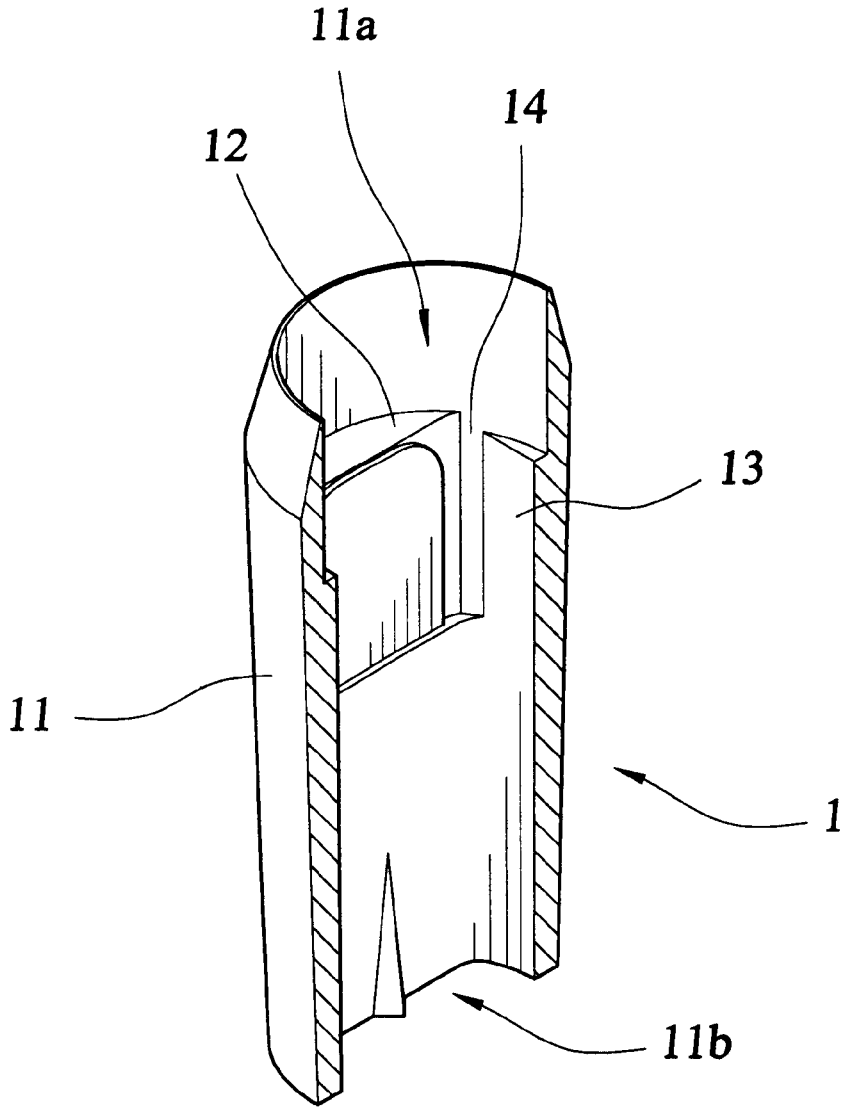
FIG. 3 is a fragmentary, sectioned perspective view of the lamp socket of the present invention.

Please also refer to FIG. 3. The lamp socket 1 includes a body portion 11, which is formed at a top with an upper opening 11*a* and at a bottom with a lower opening 11*b*. The body portion 11 is provided on an inner wall surface thereof with a pair of opposite first limiters 12 and a pair of opposite second limiters 13, such that the first limiters 12 and the second limiters 13 are disposed on the inner wall surface of the body portion 11 in a spaced and alternate relation to be substantially perpendicular to one another. Thus, a retaining cavity 14 is formed at an intersection between any two adjacent first and second limiters 12, 13.

Figure 4:
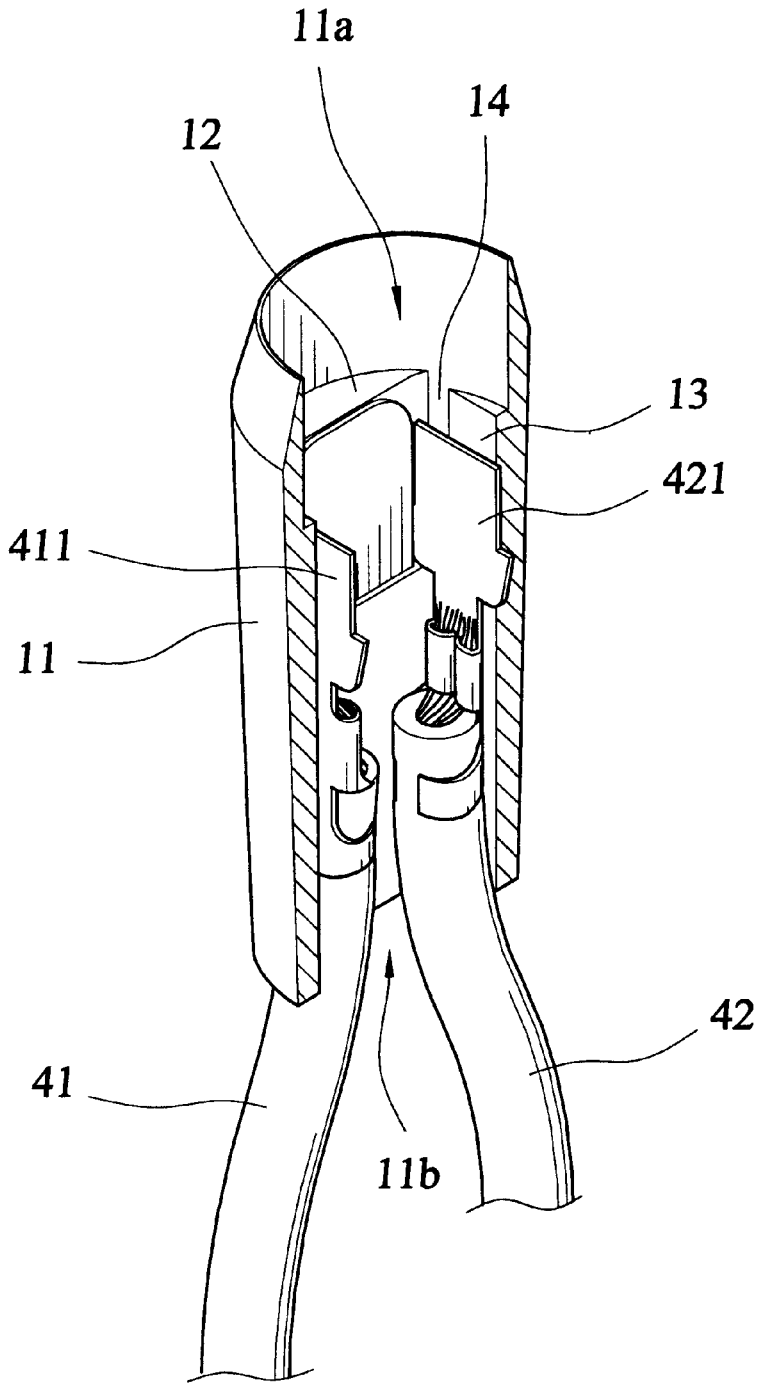
FIG. 4 is a fragmentary, sectioned perspective view of the lamp socket of the present invention having wires and metal contact plates associated therewith.

Two wires 41, 42 are provided at their one end with metal contact plates 411 and 421, respectively. The metal contact plates 411, 421 can be downward associated with the retaining cavities 14 to be securely held in place in the body portion 11, as shown in FIG. 4, with their outer sides flatly bearing against the inner wall surface of the body portion 11 of the lamp socket 1. Another end of the wires 41, 42 are led out of the body portion 11 via the lower opening 11*b* to connect to a power cord or other miniature decorative light to form a light string.

Figure 5:
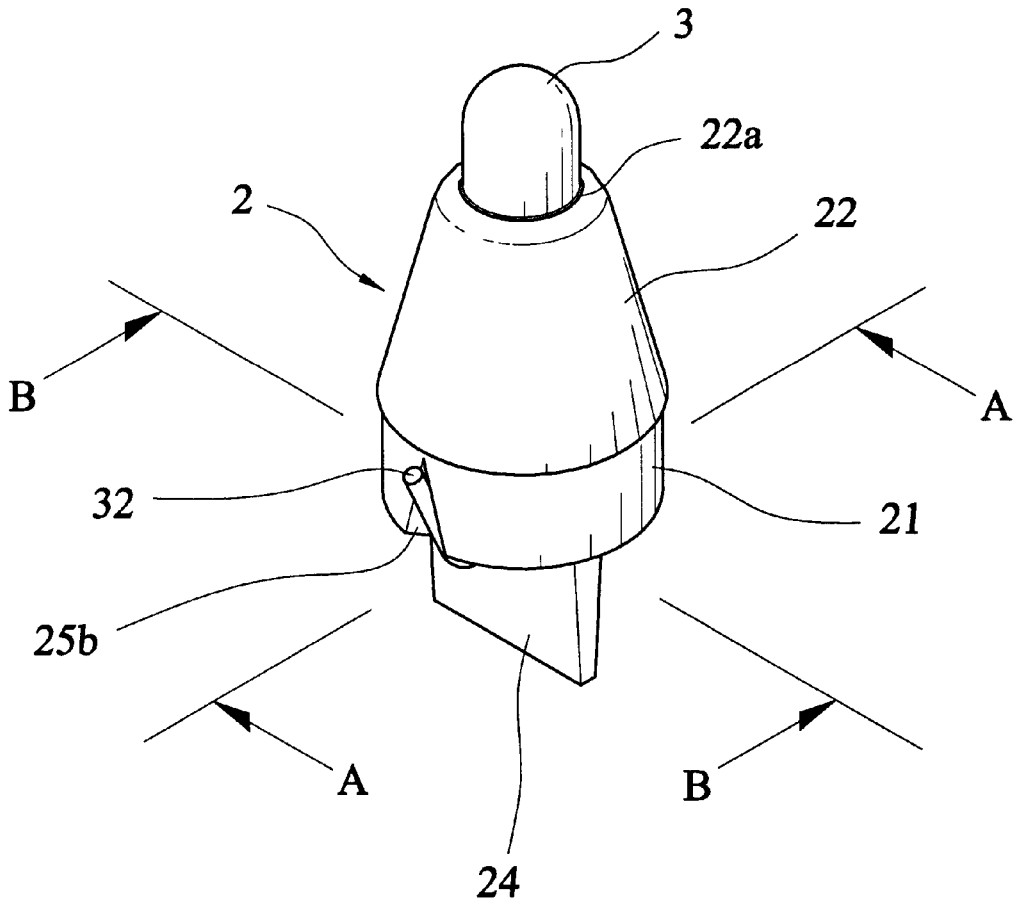
FIG. 5 is a perspective view of the miniature lamp holder of the present invention.

Please refer to FIG. 5 that is a perspective view of the miniature lamp holder 2 of the present invention. As shown, the lamp holder 2 includes a body portion 21 and an upward tapered extension portion 22 above the body portion 21. An outer wall surface of the tapered extension portion 22 has a big but proper inclination, and an upper opening 22*a* is formed at a top of the extension portion 22 for the miniature decorative lamp 3 to mount thereto.

Figure 6:
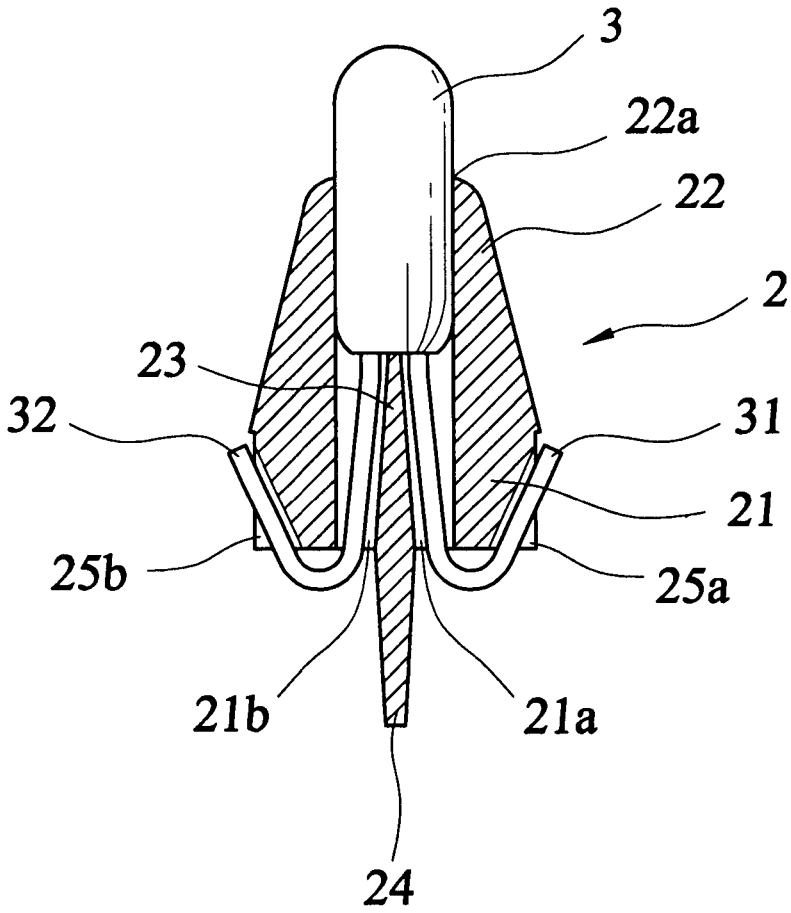
FIG. 6 is a cross-sectional view taken along line A—A of FIG. 5.
Figure 7:
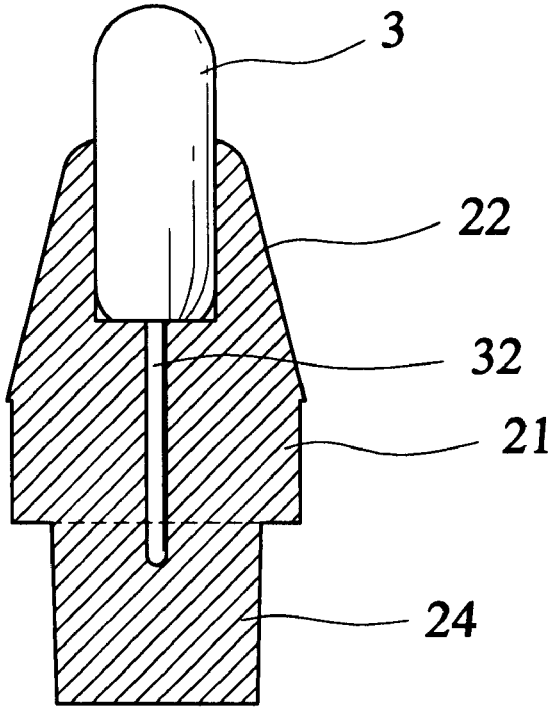
FIG. 7 is a cross-sectional view taken along line B—B of FIG. 5.

Please refer to FIG. 6 that is a cross-sectional view taken along line A—A of FIG. 5, and to FIG. 7 that is a cross-sectional view taken along line B—B of FIG. 5. As shown, the body portion 21 of the miniature lamp holder 2 defines an internal space, in which a middle dam 23 is provided. A lower part of the middle dam 23 projects from a bottom of the body portion 21 to provide a projected dam portion 24. Thus, two through holes 21*a*, 21*b* are formed at a lower part of the internal space defined in the body portion 21.

When the miniature decorative lamp 3 is mounted to the upper opening 22*a* of the tapered extension portion 22 of the miniature lamp holder 2, a bottom of the lamp 3 abuts on an upper end of the middle dam 23 to stably locate in the miniature lamp holder 2. Two connecting wires 31, 32 of the miniature decorative lamp 3 can be downward extended through the two through holes 21*a*, 21*b* at the bottom of the body portion 21 and then bent upward to flatly attach to a lower outer periphery of the body portion 21.

The provision of the middle dam 23 and the projected dam portion 24 in the miniature structure of the present invention effectively prevents the two connecting wires 31, 32 of the miniature decorative lamp 3 from contacting with each other to cause a short circuit.

Preferably, the body portion 21 of the miniature lamp holder 2 is provided at the lower outer periphery with two opposite oblique recesses 25*a*, 25*b*, so that lower ends of the two connecting wires 31, 32 of the miniature decorative lamp 3 extended through the holes 21*a*, 21*b* can be bent outward to separately locate in the two recesses 25*a*, 25*b*, preventing the connecting wires 31, 32 from undesired displacement relative to the miniature lamp holder 2.

Figure 8:
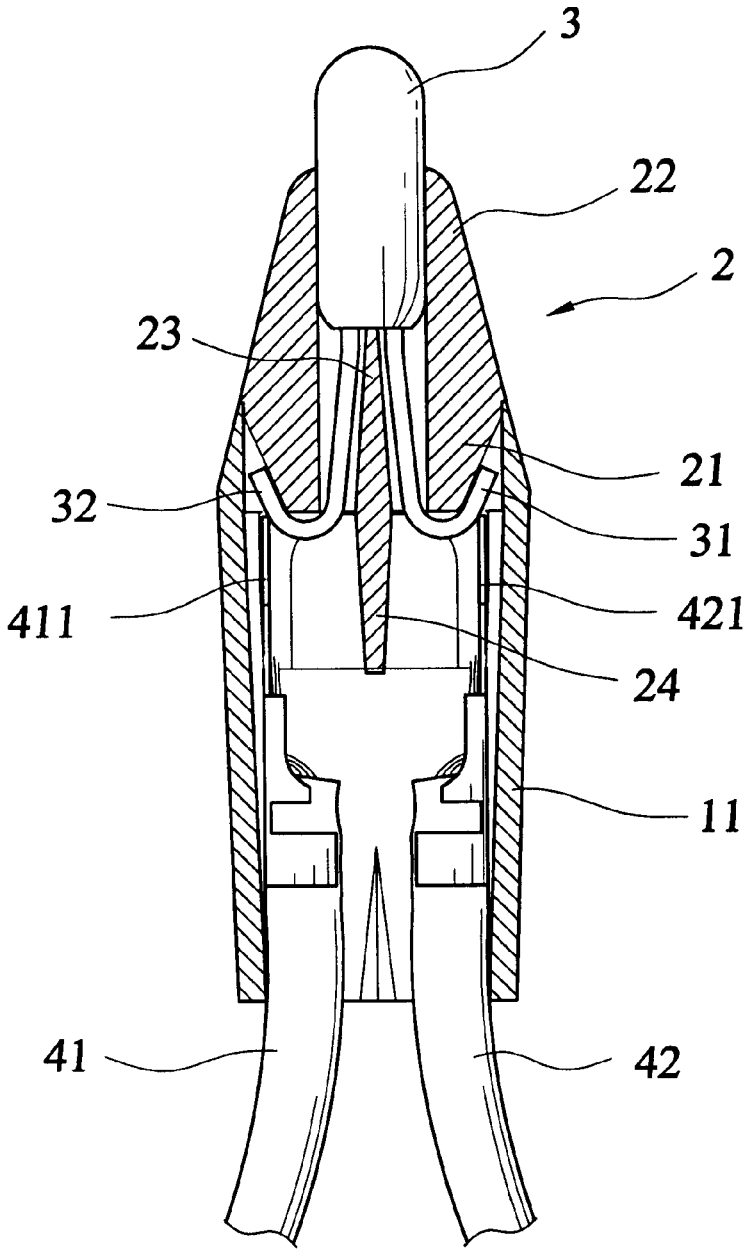
FIG. 8 is a cross-sectional view taken along line C—C of FIG. 1, showing the associated miniature decorative lamp, miniature lamp holder and lamp socket of the present invention.

Please refer to FIG. 8. When the miniature lamp holder 2 is connected to the upper opening 11*a* of the lamp socket 1, a bottom of the body portion 21 of the miniature lamp holder 2 abuts on tops of the first and the second limiters 12, 13 to stably locate in the lamp socket 1, and the connecting wires 31, 32 of the miniature decorative lamp 3 are in tight contact with the metal contact plates 411, 421.

Figure 9:
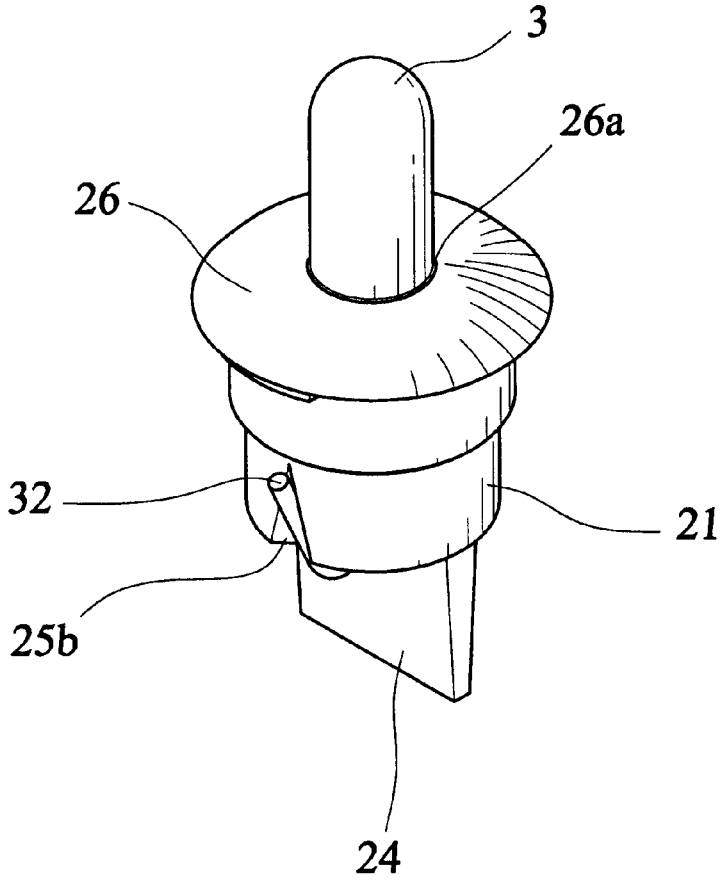
FIG. 9 is an assembled perspective view of a lamp holder and socket structure for miniature decorative light according to a second embodiment of the present invention.

Please refer to FIG. 9 that illustrates a second embodiment of the present invention. The second embodiment is substantially similar to the first embodiment, and like reference numerals are used to identify elements that are similar or identical in the two embodiments. However, the second embodiment is different from the first embodiment in that the miniature lamp holder 2 thereof has an extension portion 26 with a curved top surface provided above the body portion 21. An upper opening 26*a* is formed at a top of the extension portion 26 for the miniature decorative lamp 3 to mount thereto.

The present invention has been described with preferred embodiments thereof and it is understood that many changes and modifications in the described embodiments can be carried out without departing from the spirit and scope of the invention as defined by the appended claims.

What is claimed is:

1. A lamp holder and socket structure for holding a miniature decorative lamp, wherein the miniature decorative lamp has a bottom portion and includes a pair of connecting wires extending from said bottom portion, said lamp holder and socket structure comprising a lamp socket and a miniature lamp holder, said lamp socket comprising:

a body portion having top and bottom regions, an upper opening being formed through said top region, and a lower opening being formed through said bottom region of said body portion;

a pair of first limiters formed on an inner wall surface of said body portion of said lamp socket, said pair of first limiters being positioned in opposed relation with respect to one another;

a pair of second limiters formed on an inner wall surface of said body portion of said lamp socket, said pair of second limiters being positioned in opposed relation with respect to one another, each said second limiter being located between said pair of first limiters, retaining cavities being formed at intersections between respective ones of said first and second limiters located adjacent to each other;

a pair of metal contact plates, said metal contact plates engaging said retaining cavities in said body portion with outer surfaces of said metal contact plates bearing against the inner wall surface of said body portion, each of said pair of metal contact plates being connected at a lower end thereof to a respective wire extending out of said lamp socket via said lower opening of said lamp socket, said miniature lamp holder being secured to said lamp socket at said upper opening thereof, said miniature lamp holder comprising:

a hollow body portion having a lower opening formed through a bottom edge thereof;

an extension portion located above said hollow body portion and having an upper opening formed through a top edge of said extension portion, said miniature decorative lamp before mounted in said upper opening in said extension portion; and a middle dam member being longitudinally received in said hollow body portion of said miniature lamp holder, said middle dam member extending between the bottom edge of said miniature lamp and said lower opening of said hollow body portion of said miniature lamp holder to separate said lower opening of said hollow body portion into two through holes and to form a pair of channels within said hollow body portion, each said channel containing a respective one of said pair of connecting wires of the miniature decorative lamp, said middle dam member separating and isolating said wires each from the other, said bottom of said decorative lamp abutting a top edge of said middle dam member to stably locate the decorative lamp in said miniature lamp holder, said connecting wires of said decorative lamp extending out of said miniature lamp holder via said pair of through holes formed through the bottom edge of said body portion of said miniature lamp holder and being bent to engage a lower outer periphery of said miniature lamp holder, said bottom edge of said body portion of said miniature lamp holder abutting upper surfaces of said first and second limiters to stably locate said miniature lamp holder in said lamp socket with said pair of connecting wires of said miniature decorative lamp being held in engagement with said metal contact plates.

2. The lamp holder and socket structure as claimed in claim 1, wherein said middle dam member includes a lower part projecting from said lower opening of said body portion of said miniature lamp holder to form a projected dam portion.

3. A lamp holder and socket structure for holding a miniature decorative lamp, wherein the miniature decorative lamp has a bottom portion and includes a pair of connecting wires extending from said bottom portion, said lamp holder and socket structure comprising a lamp socket and a miniature lamp holder, said lamp socket comprising:

a body portion having top and bottom regions, an upper opening being formed through said top region, and a lower opening being formed through said bottom region of said body portion;

a pair of first limiters formed on an inner wall surface of said body portion of said lamp socket, said pair of first limiters being positioned in opposed relation with respect to one another;

a pair of second limiters formed on said inner wall surface of said body portion of said lamp socket, said pair of second limiters being positioned in opposed relation with respect to one another, each said second limiter being located between said pair of first limiters, retaining cavities being formed at intersections between respective ones of said first and second limiters located adjacent to each other;

a pair of metal contact plates, said metal contact plates engaging said retaining cavities in said body portion with outer surfaces of said metal contact plates bearing against the inner wall surface of said body portion, each of said pair of metal contact plates being connected at a lower end thereof to a respective wire extending out of said lamp socket via said lower opening of said lamp socket, said miniature lamp holder being secured to said lamp socket at said upper opening thereof, said miniature lamp holder comprising:

a hollow body portion having a lower opening formed through a bottom edge thereof;

an extension portion located above said hollow body portion and having an upper opening formed through a top edge of said extension portion, said miniature decorative lamp being mounted in said upper opening in said extension portion; and a middle dam member being longitudinally received in said hollow body portion of said miniature lamp holder, said middle dam member extending between the bottom edge of said miniature lamp and said lower opening of said hollow body portion of said miniature lamp holder to separate said lower opening of said hollow body portion into two through holes and to form a pair of channels within said hollow body portion, each said channel containing a respective one of said pair of connecting wires of the miniature decorative lamp, said middle dam member separating and isolating said wires each from the other, said bottom of said decorative lamp abutting a top edge of said middle dam member to stably locate the decorative lamp in said miniature lamp holder, said connecting wires of said decorative lamp extending out of said miniature lamp holder via said pair of through holes formed through the bottom edge of said body portion of said miniature lamp holder and being bent to engage a lower outer periphery of said miniature lamp holder, said bottom edge of said body portion of said miniature lamp holder abutting upper surfaces of said first and second limiters to stably locate said miniature lamp holder in said lamp socket with said pair of connecting wires of said miniature decorative lamp being held in engagement with said metal contact plates, two opposite oblique recesses being formed in said lower edge of said body portion of said miniature lamp holder, each of said two connecting wires of said miniature decorative lamp extending through said through holes of said miniature lamp holder and extending through a respective one of said oblique recesses to avoid undesired displacement of said connecting wires relative to said miniature lamp holder.

4. The lamp holder and socket structure as claimed in claim 1, wherein said extension portion of said miniature lamp holder located above said body portion includes an upwardly tapered outer wall surface having a large angle of inclination.

5. The lamp holder and socket structure as claimed in claim 1, wherein said extension portion of said miniature lamp holder located above said body portion includes a curved top surface.

* * * * *